US008919931B2

(12) United States Patent
Yokota

(10) Patent No.: US 8,919,931 B2
(45) Date of Patent: Dec. 30, 2014

(54) INK JET HEAD AND INK JET RECORDING APPARATUS

(75) Inventor: Yasuyo Yokota, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 183 days.

(21) Appl. No.: 13/610,591

(22) Filed: Sep. 11, 2012

(65) Prior Publication Data

US 2013/0076836 A1 Mar. 28, 2013

(30) Foreign Application Priority Data

Sep. 27, 2011 (JP) ..... 2011-210881

(51) Int. Cl.

| | |
|---|---|
| ***B41J 2/05*** | (2006.01) |
| ***B41J 2/04*** | (2006.01) |
| ***B41J 2/18*** | (2006.01) |
| ***B41J 2/14*** | (2006.01) |

(52) U.S. Cl.

CPC .... *B41J 2/14274* (2013.01); *B41J 2002/14419* (2013.01)

USPC ..... 347/65; 347/54; 347/89

(58) Field of Classification Search

None

See application file for complete search history.

(56) References Cited

U.S. PATENT DOCUMENTS

| | | | | |
|---|---|---|---|---|
| 6,343,857 | B1 | 2/2002 | Cowger | |
| 7,604,327 | B2 * | 10/2009 | Sugahara | 347/56 |
| 8,061,818 | B2 | 11/2011 | Murakami | |
| 2003/0011655 | A1 | 1/2003 | Miyagawa et al. | |
| 2009/0141091 | A1 | 6/2009 | Murakami | |
| 2010/0238238 | A1 | 9/2010 | Yamamoto | |

FOREIGN PATENT DOCUMENTS

| | | | | |
|---|---|---|---|---|
| JP | H07-251508 | A | 10/1995 | |
| JP | 2003-025595 | A | 1/2003 | |
| JP | 2006-069113 | A | 3/2006 | |
| JP | 2009-132080 | A | 6/2009 | |
| JP | 2010-069669 | A | 4/2010 | |
| JP | 2010-214847 | A | 9/2010 | |
| JP | 2011-110730 | * | 6/2011 | B41J 2/045 |

OTHER PUBLICATIONS

An Office Action; "Notice of Reasons for Rejection," issued by the Japanese Patent Office on Aug. 22, 2013, which corresponds to Japanese Patent Application No. 2011-210881 and is related to U.S. Appl. No. 13/610,591; with translation.

* cited by examiner

*Primary Examiner* — Geoffrey Mruk

(74) *Attorney, Agent, or Firm* — Studebaker & Brackett PC

(57) ABSTRACT

An ink jet head is provided which includes: nozzles forming a predetermined array; liquid chambers respectively provided for the nozzles; pressure generation elements respectively provided for the liquid chambers which respectively discharge liquid in the liquid chambers; individual supply flow paths which respectively supply the liquid to the liquid chambers; a common supply flow path that is connected to each individual supply flow path and supplies the liquid into each individual supply flow path; and a liquid supply unit that circulates the liquid of the common supply flow path so as to make the liquid flow in one direction in the common supply flow path. The common supply flow path has a shape in which a cross-sectional area is increased and decreased at a predetermined interval. Each individual supply flow path is provided at a position where the cross-sectional area of the common supply flow path is increased.

17 Claims, 17 Drawing Sheets

INK JET HEAD AND INK JET RECORDING APPARATUS

BACKGROUND OF THE INVENTION

1. Field of the Invention

The present invention relates to an ink jet head and an ink jet recording apparatus, and particularly, to an ink jet head and an ink jet recording apparatus which discharge ink from nozzles via a plurality of pressure chambers from a common flow path.

2. Description of the Related Art

In the past, as an image forming apparatus, an ink jet recording apparatus which has an ink jet head in which a large number of nozzles are arranged, and which forms an image on a recording medium by discharging ink as droplets toward the recording medium from the nozzles while moving the ink jet head and the recording medium relatively has been known.

As such an ink jet recording apparatus, for example, in JP2010-69669A, there is disclosed a droplet discharge device which includes storage means that stores liquid and is provided with a delivery port and a return port for the stored liquid, a circulation pathway having a first circulation portion in which liquid circulates at a first predetermined flow velocity and a second circulation portion in which liquid circulates at a second flow velocity faster than the first flow velocity, and which is for circulating liquid so as to send liquid stored in the storage means from the delivery port and then return liquid from the return port to the storage means, circulation means that circulates liquid in the circulation pathway, and droplet discharge means which discharges droplets and in which a supply port for liquid for discharging droplets and the first circulation portion are connected to each other and a discharge port for liquid and the second circulation portion are connected to each other.

In an image forming apparatus having an ink jet head, such as an ink jet recording apparatus, a configuration is made so as to discharge ink droplets from a recording head (a liquid discharge head) by supplying ink from an ink tank that stores ink via an ink supply flow path to the ink jet head and driving a drive element provided in each discharge element of the recording head by applying a drive signal from a drive signal generation source.

As an ink jet recording head of an ink jet recording apparatus having such a structure, for example, in JP2006-69113A, there is disclosed an ink jet recording head which is provided with a plurality of blocks each having a group of nozzles disposed in a matrix form and an ink supply flow path composed of a branch path and a pair of main paths communicating with both ends of the branch path and in which ink is supplied to a nozzle via the branch path of the ink supply flow path.

SUMMARY OF THE INVENTION

If ink droplets are discharged from each discharge element, the discharge element is refilled with ink via a flow path on the supply side. Further, if discharge energy is applied to ink in each discharge element, not only ink which is discharged from a nozzle, but also ink which is pushed back to an ink flow path on the supply side is present. A drive element needs to apply the discharge element energy (discharge power) including not only enough energy to discharge ink from the nozzle, but also enough energy to push ink back to the ink flow path on the supply side. In order to reduce the amount of ink that is pushed back to the ink flow path on the supply side at the time of discharge, the reduction can be performed by increasing the flow path resistance of the ink flow path on the supply side. However, if the flow path resistance is increased, it takes a long time to perform refill, and thus, when using a large amount of liquid, such as at the time of high-speed discharge, a failure to perform refill in time may occur. If refill is delayed, a problem arises in that variation in droplet discharge velocity or droplet amount occurs, and thus normal discharge cannot be performed.

In an ink jet recording apparatus having such an ink jet recording head, in order to form a high-quality image, it is necessary to perform discharge stably such that the discharge ink amount, discharge velocity, discharge direction, discharge ink shape (volume), and the like are always constant.

The present invention has been made in view of such circumstances and has an object of providing an ink jet head and an ink jet recording apparatus in which the refill efficiency to a pressure chamber is increased, and thus discharge can be stably performed.

In order to achieve the above-described object, according to an aspect of the invention, there is provided an ink jet head including a plurality of nozzles forming a predetermined array; a plurality of liquid chambers respectively provided for the nozzles, a plurality of pressure generation elements respectively provided for the liquid chambers, which pressure generation elements respectively discharge liquid in the liquid chambers as a droplet from the nozzles; a plurality of individual supply flow paths which respectively supply the liquid to the liquid chambers; a common supply flow path that is connected to each individual supply flow path and supplies the liquid into each individual supply flow path; and a liquid supply unit that circulates the liquid of the common supply flow path so as to make the liquid flow in one direction in the common supply flow path, wherein the common supply flow path has a shape in which a cross-sectional area is increased and decreased at a predetermined interval along an extending direction of the common supply flow path, and wherein each individual supply flow path is provided at a position where the cross-sectional area of the common supply flow path is increased.

According to the above aspect of the invention, the cross-sectional area of the common supply flow path is changed at a predetermined interval and the individual supply flow path that is connected to a pressure chamber serving as the liquid chamber is connected to a position where the cross-sectional area is large. Since at the position where the cross-sectional area is large, pressure becomes high due to the Venturi effect, flow of liquid to the individual supply flow path can be facilitated, and thus refill efficiency can be improved.

In the ink jet head related to another aspect of the invention, it is preferable that the individual supply flow paths be provided on both sides of the common supply flow path.

According to the above aspect of the invention, since the individual supply flow paths are provided on both sides of the common supply flow path, many nozzles can be disposed and the nozzle can be densified.

In the ink jet head related to another aspect of the invention, it is preferable that the individual supply flow paths be provided on opposite sides facing each other of adjacent common supply flow paths.

According to the above aspect of the invention, since the individual supply flow paths are provided on opposite sides facing each other of adjacent common supply flow paths, the nozzles can be densely formed in two-dimensional disposition.

In the ink jet head related to another aspect of the invention, it is preferable that the cross-sectional area of the common supply flow path be increased and decreased at the predetermined interval by narrowing or widening a flow path width of the common supply flow path.

According to the above aspect of the invention, the cross-sectional area of the common supply flow path can be changed by narrowing or widening the flow path width.

In the ink jet head related to another aspect of the invention, it is preferable that the cross-sectional area of the common supply flow path be increased and decreased at the predetermined interval by providing an island-shaped member in the common supply flow path.

According to the above aspect of the invention, since the cross-sectional area of the common supply flow path can be changed by providing the island-shaped members in the common supply flow path, the production of the flow path can be performed without a complex manufacturing process for changing the side surfaces of the common supply flow path.

In the ink jet head related to another aspect of the invention, it is preferable that a space be provided between the island-shaped member and an upper surface of the common supply flow path.

According to the above aspect of the invention, since the space is provided between the island-shaped member in the common supply flow path and the upper surface of the common supply flow path, whereby air bubbles mixed into the common supply flow path can be discharged via the space, air bubbles can be prevented from entering the individual supply flow path (or the pressure chamber) on the downstream side.

In the ink jet head related to another aspect of the invention, it is preferable that both side surfaces of the common supply flow path be formed so as to make the liquid in the common supply flow path flow in a same direction and the common supply flow path have an area where the flow path width narrows and an area where the flow path width widens, whereby the cross-sectional area is increased and decreased at the predetermined interval.

According to the above aspect of the invention, since both side surfaces of the common supply flow path are formed so as to make liquid in the common supply flow path flow in the same direction and the common supply flow path is formed so as to have different flow path widths, refill efficiency can be further improved by supplying liquid into the supply flow path with a difference in pressure due to a difference in cross-sectional area and making liquid flow in a flow direction in the supply flow path.

It is preferable that the ink jet head related to another aspect of the invention further include a plurality of circulation flow paths which respectively circulate the liquid in the liquid chambers to the common supply flow path and each circulation flow path be connected to a position where the cross-sectional area of the common supply flow path is decreased.

According to the above aspect of the invention, since the circulation flow path that circulates liquid in the pressure chamber to the common supply flow path is provided, circulation of liquid in the vicinity of the nozzle can be performed, and thus thickening of liquid in the pressure chamber can be prevented. Further, discharge of foreign matters and/or air bubbles can be performed. In addition, retention of a meniscus face in the nozzle can be easily performed.

Further, since the circulation flow path is connected to a position where the cross-sectional area of the common supply flow path is small, pressure at the position where the cross-sectional area of the common supply flow path is small is reduced due to the Venturi effect, and thus flow of liquid to the common supply flow path can be facilitated.

In the ink jet head related to another aspect of the invention, it is preferable that the circulation flow path be connected to the common supply flow path further on the downstream side than a position where a corresponding individual supply flow path is connected to the common supply flow path.

It is preferable that the ink jet head related to another aspect of the invention further include a common recovery flow path having a shape in which a cross-sectional area is increased and decreased at a predetermined interval, and a plurality of circulation flow path which respectively circulate the liquid in the liquid chambers to the common recovery flow path, and each circulation flow path be provided at a position where the cross-sectional area of the common recovery flow path is decreased.

According to the above aspect of the invention, the common recovery flow path is provided and liquid from the pressure chamber is circulated to the common recovery flow path, whereby foreign matters or air bubbles in the pressure chamber can be discharged into the common recovery flow path. Further, foreign matters or air bubbles in the pressure chamber are discharged to the common recovery flow path rather than to the common supply flow path, whereby foreign matters or air bubbles discharged from the pressure chamber can be prevented from flowing into the individual supply flow path provided on the downstream side of the common supply flow path and then entering the downstream pressure chamber.

Further, the circulation flow path is connected to the portion with a small cross-sectional area of the common recovery flow path, whereby pressure in the common recovery flow path can be lowered and discharge from the circulation flow path to the common recovery flow path can be easily performed due to the Venturi effect.

In order to achieve the above-described object, according to another aspect of the invention, there is provided an ink jet recording apparatus including the ink jet head described above.

Since the ink jet recording apparatus is provided with the ink jet recording head described above, whereby the refill efficiency to the ink jet recording head can be improved, a high-quality image can be formed.

According to the ink jet head and the ink jet recording apparatus related to the invention, since the cross-section area of a common ink flow path is made large or small corresponding to an interval between individual flow paths and the individual flow path is provided at a position where the cross-sectional area is large, pressure in a portion with a large cross-sectional area can be increased due to the Venturi effect by making ink of a certain flow rate or more flow in the common ink flow path. Therefore, since flow of ink to the individual flow path side can be facilitated, refill efficiency can be improved. Further, since ink being pushed back to the supply side at the time of discharge can also be prevented, discharge efficiency can be improved.

DESCRIPTION OF THE PREFERRED EMBODIMENTS

Hereinafter, preferred embodiments of the invention will be described according to the accompanying drawings.

Overall Configuration of Ink Jet Head

Figure 1:
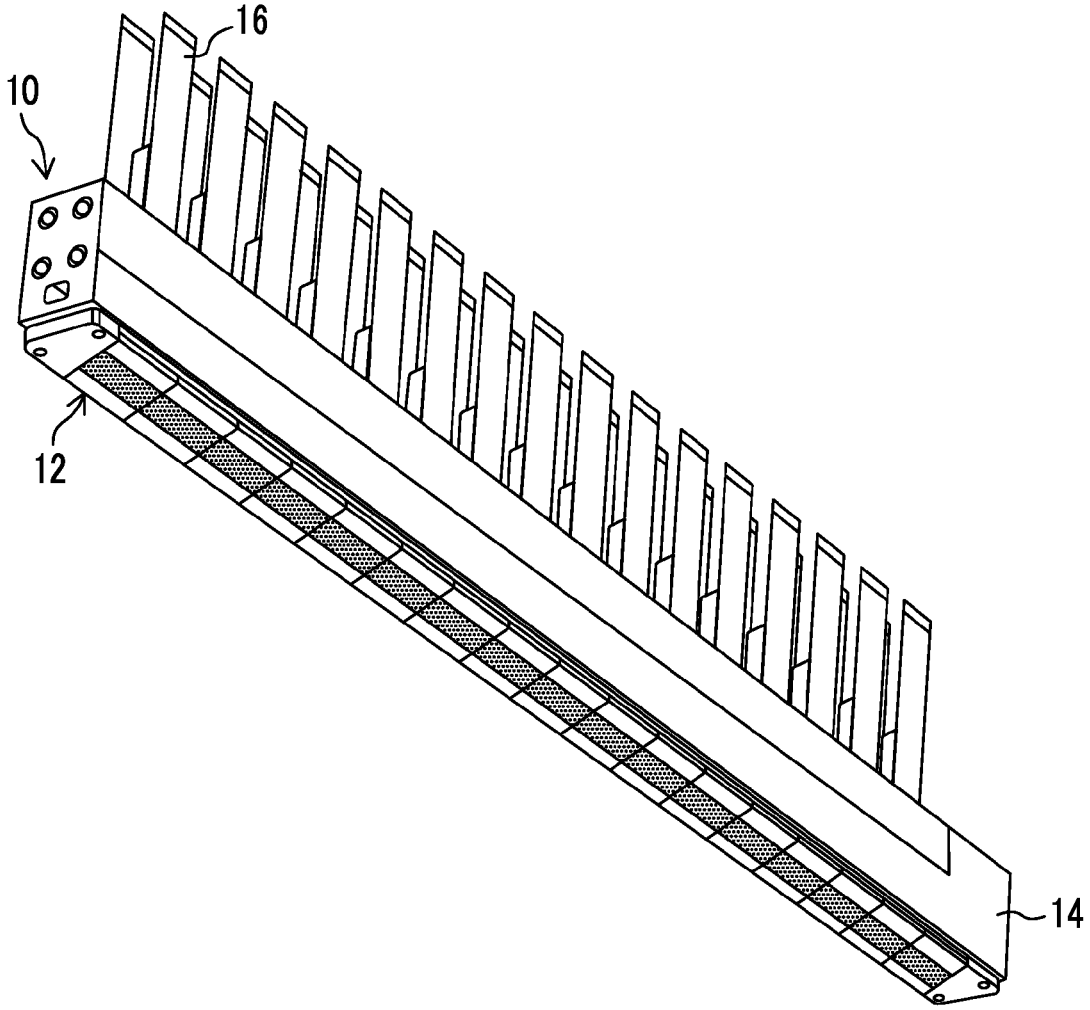
FIG. 1 is an oblique perspective view of an ink jet head related to an embodiment of the invention.

In FIG. 1, an oblique perspective view of an ink jet head related to an embodiment of the invention is illustrated. In FIG. 1, an appearance of an ink jet head 10 when looking up at a discharge face from below (an obliquely lower direction) is illustrated. The ink jet head 10 is a print head that is mounted on a drawing unit of an ink jet printer, and is a full line type bar head (a single-pass printing type paper-wide head) in which a plurality of head modules 12 is connected side by side in a paper width direction so as to make a length longer. Here, an example in which 17 head modules 12 are connected is illustrated. However, the configuration of the module and the number and an array form of modules are not limited to the illustrated example. Reference numeral 14 denotes a housing (a housing for constituting a bar-shaped line head) which is a frame body for fixing the plurality of head modules 12, and reference numeral 16 denotes a flexible substrate connected to each head module 12.

The number and an array form of nozzles 22 which are formed in a discharge face 24 of the head module 12 are not particularly limited. However, an example thereof is illustrated in FIG. 2.

Figure 2:
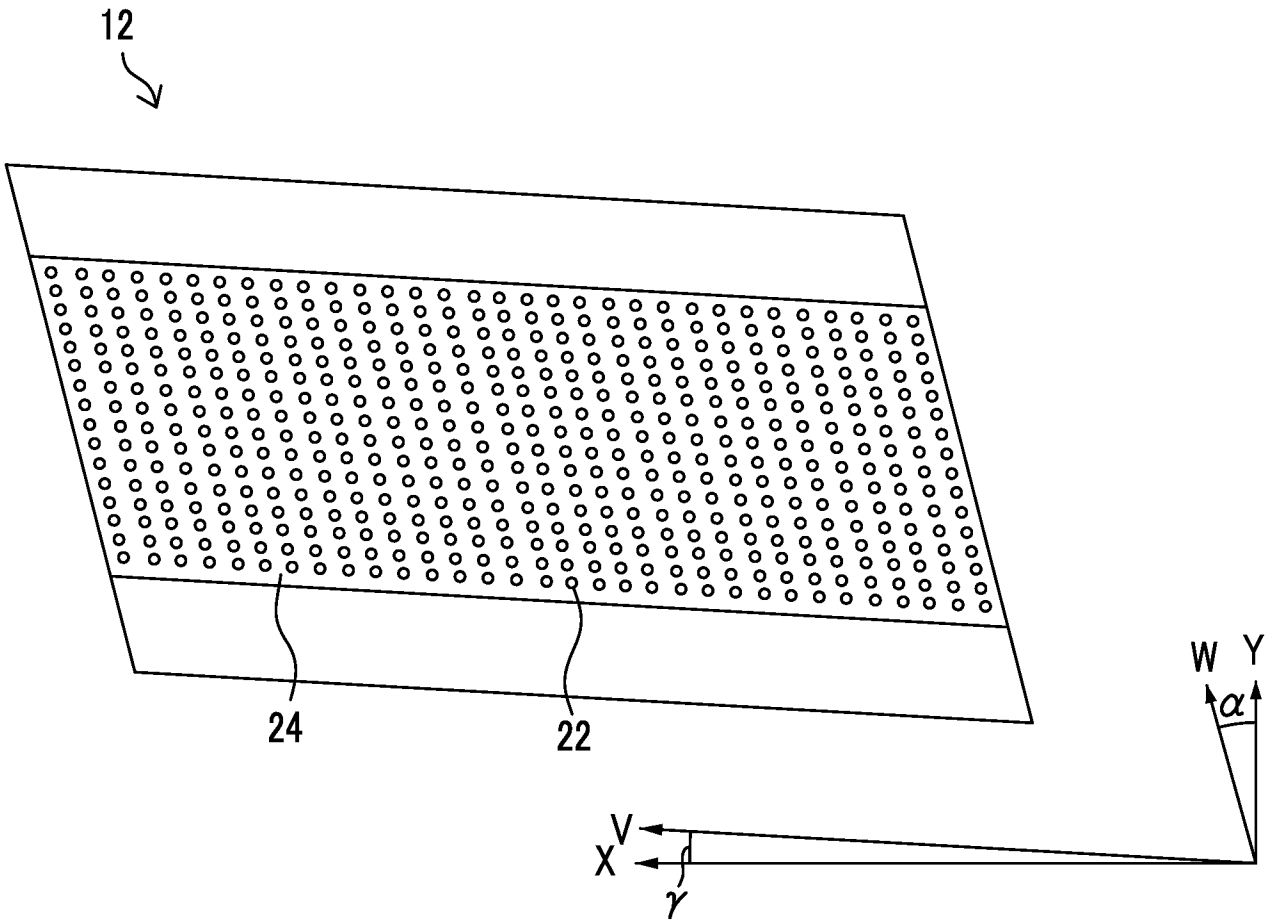
FIG. 2 is a plan view of a nozzle face in a head module.

FIG. 2 is a plan view of a nozzle face in the head module 12 (a diagram as viewed from the discharge side). In FIG. 2, the head module 12 is drawn with the number of nozzles abbreviated. However, for example, 32×64 nozzles 22 are two-dimensionally arranged in the ink discharge face of a single head module 12. In FIG. 2, the Y direction is a recording medium (paper) feeding direction (a sub-scanning direction), and the X direction is a recording medium width direction (a main scanning direction). The head module 12 has a planar shape of a parallelogram having an end face on the long side along a v direction having an inclination of an angle $\gamma$ with respect to the X direction, and an end face on the short side along a w direction having an inclination of an angle $\alpha$ with respect to the Y direction. By connecting a plurality of head modules 12 in the X direction (the paper width direction), as in FIG. 1, a nozzle row covering the entire drawing range with respect to a paper width is formed, and a full line type head, in which image recording with a predetermined recording resolution (for example, 1200 dpi) can be performed with a single drawing scanning, is constituted.

Figure 3:
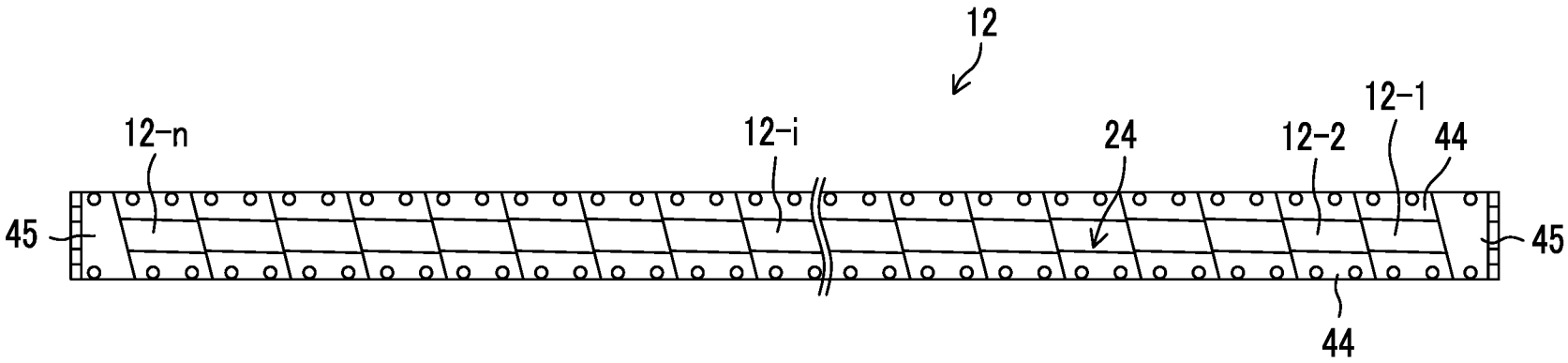
FIG. 3 is a plan view illustrating a configuration example of the ink jet head illustrated in FIG. 1.
Figure 4:
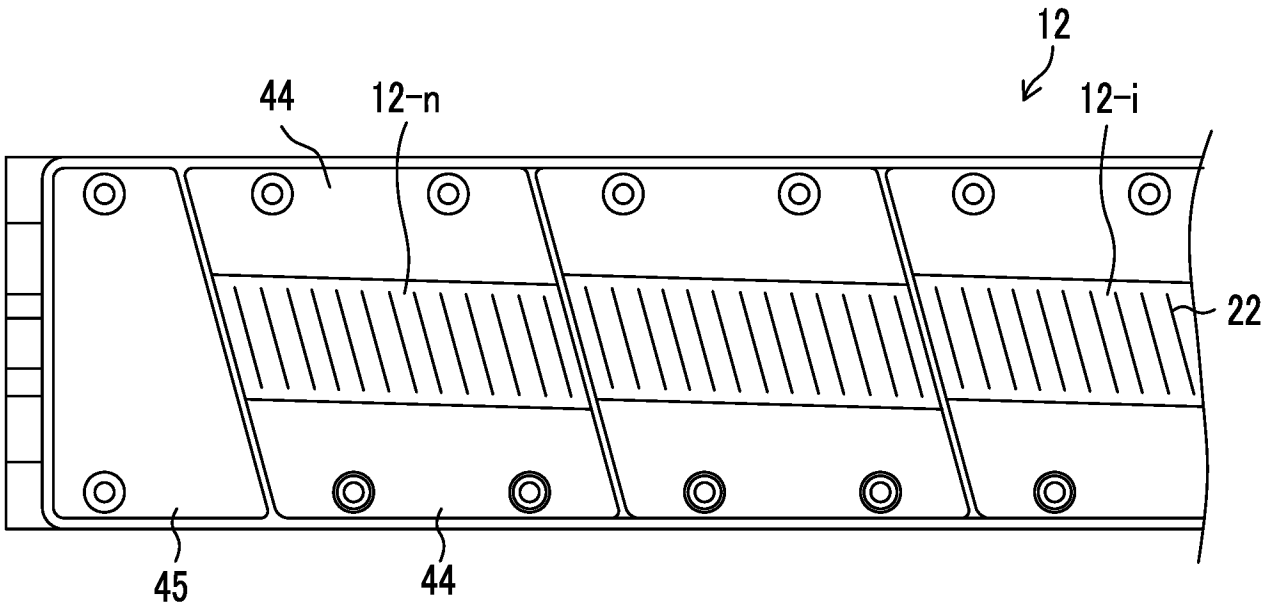
FIG. 4 is an enlarged view of a portion of FIG. 3.

FIG. 3 is a plan view illustrating a structure example of the ink jet head 10 and is a diagram as viewed from the discharge face 24 side of the ink jet head 10. FIG. 4 is an enlarged view of a portion of FIG. 3.

As illustrated in FIG. 3, the ink jet head 10 has a structure in which n head modules 12-*i* (i=1, 2, 3, . . . , n) are connected along a longitudinal direction (a direction orthogonal to a transport direction of the recording medium), and a plurality of nozzles (not illustrated in FIG. 3 and illustrated with it denoted by reference numeral 22 in FIG. 2) is provided over a length corresponding to the entire width of the recording medium.

Each head module 12-*i* is supported by head module supporting members 44 from both sides in a short side direction of the ink jet head 10. Further, both end portions in a longitudinal direction of the ink jet head 10 are supported by head supporting members 45.

As illustrated in FIG. 4, each head module 12-*i* (the n-th head module 12-*n*) has a structure in which the plurality of nozzles (not illustrated in FIG. 4 and illustrated with it denoted by reference numeral 22 in FIG. 2) is arranged in a matrix form. A diagonal solid line illustrated with it denoted by reference numeral 22 in FIG. 4 represents a nozzle row in which the plurality of nozzles is arranged in a row.

Figure 5:
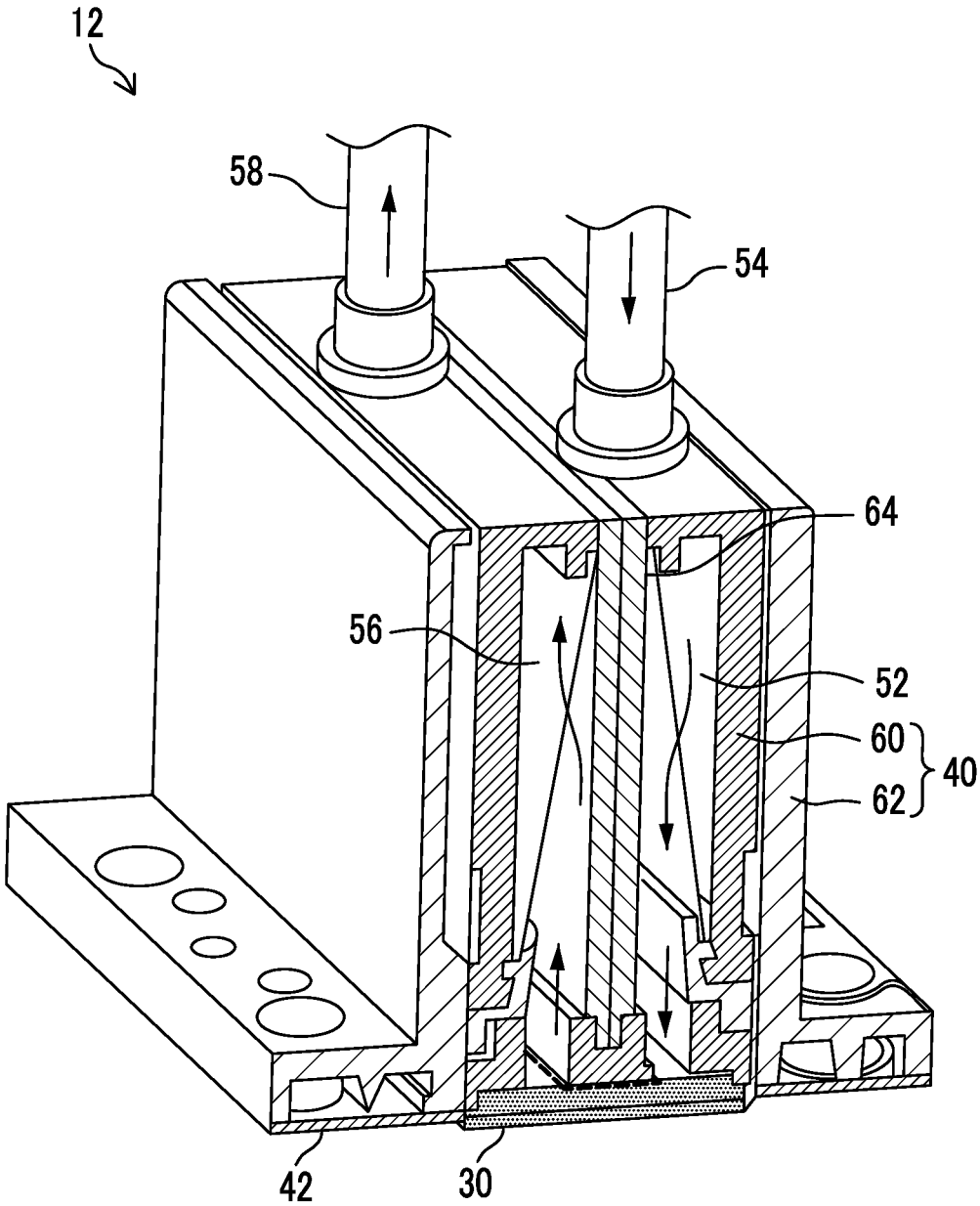
FIG. 5 is an oblique perspective view of the head module.

FIG. 5 is an oblique perspective view (a diagram which includes a cross-sectional view in a portion) of the head module 12. The head module 12 has an ink supply/circulation unit which includes an ink supply chamber 52, an ink circulation chamber 56 or the like, on the opposite side (the upper side in FIG. 5) to the discharge face 24 in a discharge device substrate 30. The ink supply chamber 52 is connected to an ink tank (not illustrated) via a supply pipe line 54, and the ink circulation chamber 56 is connected to a recovery tank (not illustrated) via a circulation pipe line 58.

A housing 40 of the head module 12 is formed in a double structure having an internal housing 60 and an external housing 62 that covers the outside of the internal housing 60. A partition wall member 64 which separates the ink supply chamber 52 and the ink circulation chamber 56 is disposed approximately at the center of the internal housing 60, and spaces of both the chambers are separated with the partition wall member 64 interposed therebetween. Although illustration is omitted in FIG. 5, the flexible substrate 16 is sandwiched between the internal housing 60 and the external housing 62 and drawn out to the upper side in FIG. 5 (refer to FIG. 1).

Flow Path Structure of Ink Jet Head

First Embodiment

Figure 6:
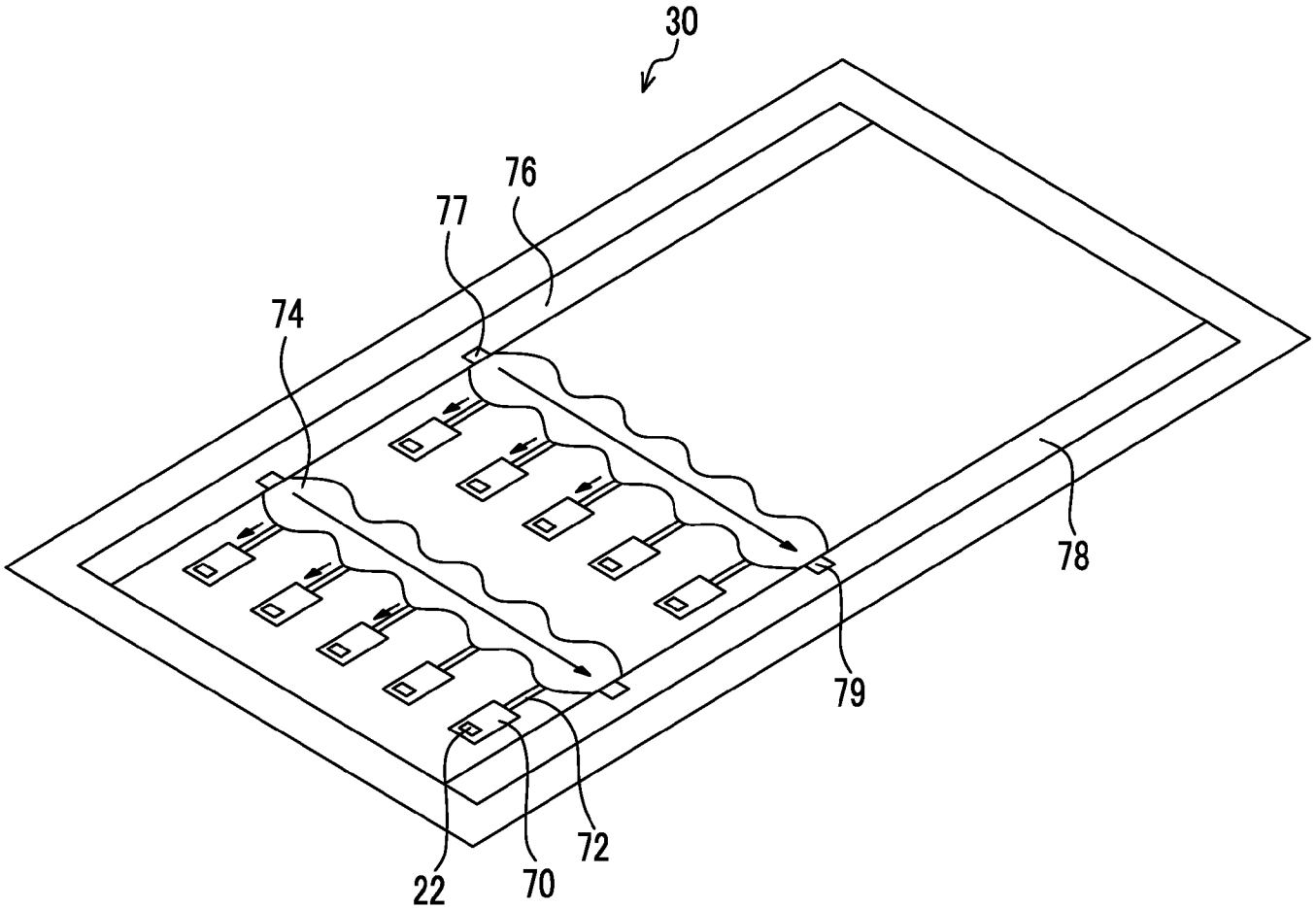
FIG. 6 is a planar perspective view illustrating the flow of liquid in a discharge device substrate related to a first embodiment.
Figure 7:
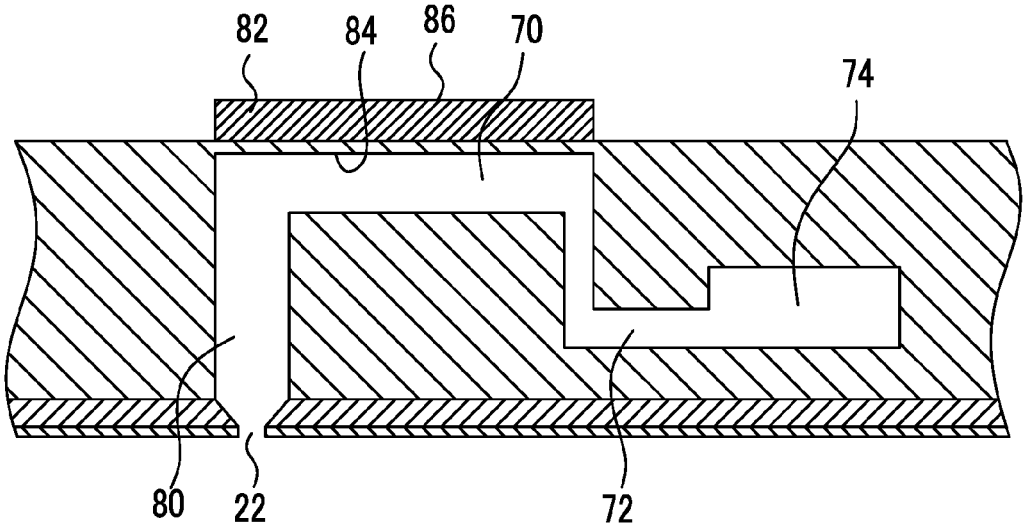
FIG. 7 is a cross-sectional view of the discharge device substrate illustrated in FIG. 6.

FIG. 6 is a planar perspective view illustrating the flow of liquid in the discharge device substrate 30. Further, FIG. 7 is a cross-sectional view illustrating a stereoscopic configuration of the ink jet head. In addition, in FIGS. 6, 8 to 15, and 17, in order to make it easy to describe the flow of liquid in the discharge device substrate 30, description will be performed with the number of nozzles and an array of the nozzles abbreviated and simplified, As illustrated in FIGS. 6 and 7, each nozzle 22 communicates with each pressure chamber (liquid chamber) 70. The pressure chambers 70 are disposed at a certain pitch along the array of the nozzles 22. Each pressure chamber 70 communicates with a common supply flow path 74 via an individual supply flow path 72. The common supply flow path 74 is disposed along the array of the pressure chambers 70 (the array of the nozzles 22).

An end portion on one side of the common supply flow path 74 is connected to a circulation supply flow path 76 via a supply port 77 in a direction intersecting the individual supply flow path 72. In addition, an end portion on the other side is connected to a circulation recovery flow path 78 via a recovery port 79 in a direction intersecting the individual supply flow path 72. Further, the circulation supply flow path 76 is connected to the supply pipe line 54 illustrated in FIG. 5 and the circulation recovery flow path 78 is connected to the circulation pipe line 58, whereby liquid flows and is circulated in a direction shown by an arrow in the drawing. The supply pipe line 54, the circulation supply flow path 76, the supply port 77, the circulation recovery flow path 78, the recovery port 79, and the circulation pipe line 58 serves as a liquid supply unit.

The common supply flow path 74 is formed such that the cross-sectional area of the common supply flow path 74 changes, that is, the cross-sectional area of the common supply flow path 74 is increased and decreased, as illustrated in FIG. 6. Also, the individual supply flow path 72 is connected to a position where the cross-sectional area of the common supply flow path 74 becomes large, that is, a position corresponding to an area where the cross-sectional area is increased, as illustrated in FIG. 6. Assuming that the flow rate of ink which is supplied to the individual supply flow path 72 is minute compared to the flow rate of ink that flows via the common supply flow path 74, in a case where the flow rate flowing via the common supply flow path 74 is constant, the Venturi effect is present in which pressure becomes large at the portion with an increased cross-sectional area of the common supply flow path 74 and pressure becomes small at the portion with a decreased cross-sectional area of the common supply flow path 74. Therefore, by connecting the supply side of the individual supply flow path 72 to the portion with the increased cross-sectional area of the common supply flow path 74, liquid is pressed with the pressure from the common supply flow path 74. Accordingly, even in a case the resistance of throttling from the individual supply flow path 72 to the pressure chamber 70 is increased, refill can be performed effectively.

In addition, since the pressure on the common supply flow path 74 side is higher than the pressure in the pressure chamber 70 at the time of discharge, a return of liquid from the pressure chamber at the time of discharge can also be suppressed, and thus discharge efficiency can be improved.

As the shape of the common supply flow path 74 is not particularly limited, and each of the side surfaces of the common supply flow path 74 may be formed into a curved surface, as illustrated in FIG. 6. Alternatively, the side surface of the common supply flow path 74 may also be formed in a quadrangular shape. However, in order to prevent retention of liquid, it is preferable to form the side surface into a curved surface, as illustrated in FIG. 6.

Further, it is preferable that a predetermined interval at which the cross-sectional area of the common supply flow path 74 changes correspond to an interval between the individual supply flow paths 72, that is, an interval between the nozzles 22. Further, it is preferable that the cross-sectional area also change at a constant size. By changing the cross-sectional area at a predetermined interval and at a constant size, liquid can be stably supplied to the individual supply flow paths 72.

Further, it is preferable that a position where the individual supply flow path 72 is connected to the common supply flow path 74 be a position where the cross-sectional area of the common supply flow path 74 is largest, because great pressure can be obtained at the position. However, if sufficient refill efficiency can be obtained, the position is not particularly limited.

FIG. 7 is a cross-sectional view of the discharge device substrate 30 along a line orthogonal to an extending direction of the common supply flow path 74 in FIG. 6. The discharge device substrate 30 has the common supply flow path 74 in the inside, as illustrated in FIG. 7. The individual supply flow path 72 is connected to the common supply flow path 74 and the pressure chamber 70, and the pressure chamber 70 is connected to a communication path 80. Further, the communication path 80 and the nozzle 22 are connected, and a droplet is discharged from the nozzle 22 via the communication path 80 due to a pressure change of the pressure chamber 70. Further, a piezoelectric element 82 provided with an individual electrode 86 is joined to a vibration plate 84 constituting the upper surface of the pressure chamber 70 and doubling as a common electrode.

By applying a drive voltage to the individual electrode 86 provided at a corresponding pressure chamber 70 (nozzle 22) depending on an image signal of an image to be drawn, the piezoelectric element 82 is deformed, and thus the volume of the pressure chamber 70 changes, and ink is discharged from the nozzle 22 via the communication path 80 due to a pressure change according to the volume change.

The individual supply flow path 72 serves as a throttle portion having a flow path structure narrower than the common supply flow path 74 and the pressure chamber 70. Therefore, return of liquid from the pressure chamber 70 to the common supply flow path 74 can be prevented. Further, as described above, in this embodiment, since the cross-sectional area of the common supply flow path 74 at a position where the individual supply flow path 72 is provided is increased, refill efficiency can be improved. Therefore, even if a throttle portion of the individual supply flow path 72 is too narrow, supply of liquid from the common supply flow path 74 can be performed efficiently.

Modified Examples

Figure 8:
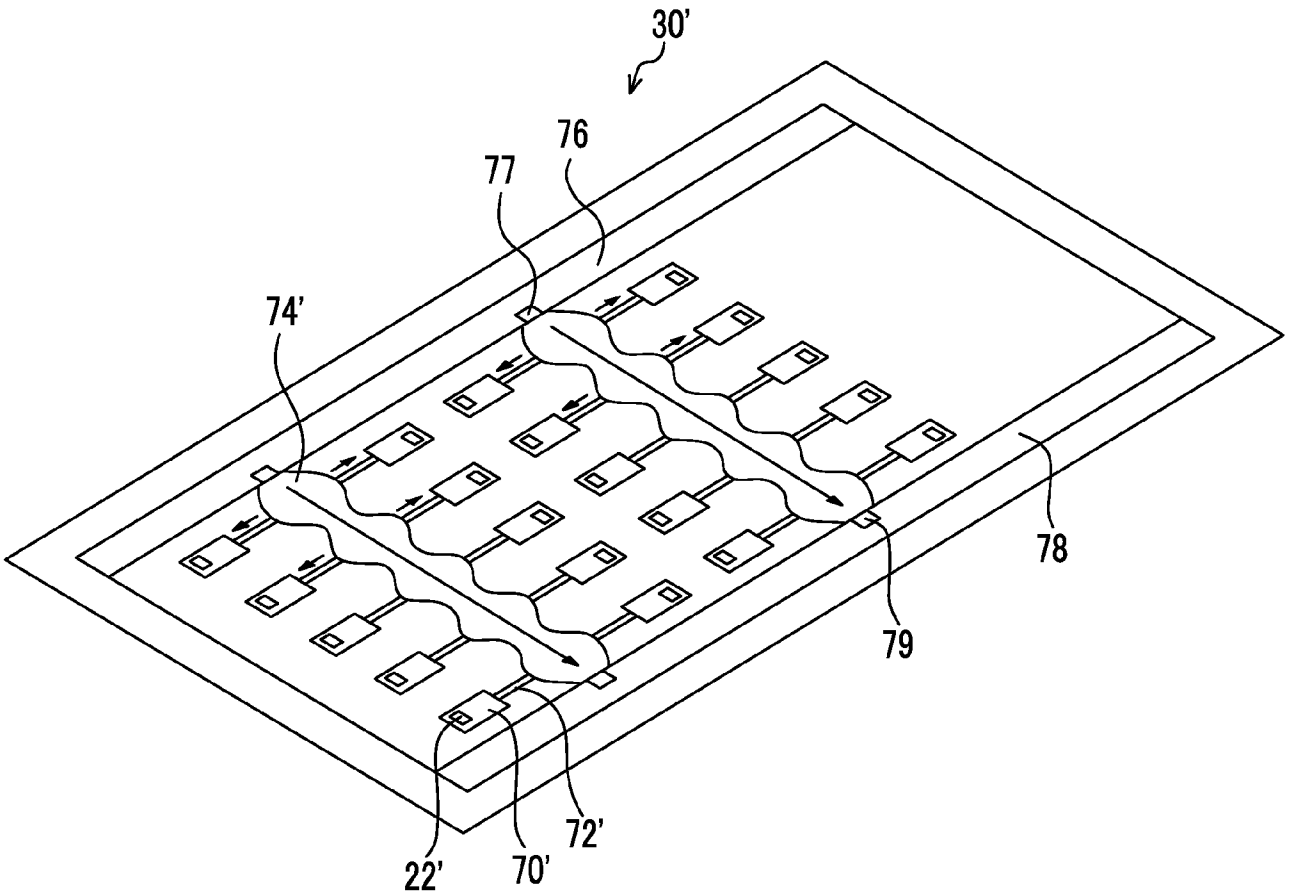
FIG. 8 is a planar perspective view illustrating the flow of liquid in a modified example of the discharge device substrate related to the first embodiment.

FIG. 8 is a planar perspective view of a discharge device substrate 30' illustrating a modified example of an ink jet head module related to the first embodiment. An ink jet head module illustrated in FIG. 8 is different from that of the above-described embodiment in that nozzles 22' are provided via individual supply flow paths 72' provided on both sides from a single common supply flow path 74'. With such a configuration, the nozzles 22' can be disposed at a high density.

Figure 9:
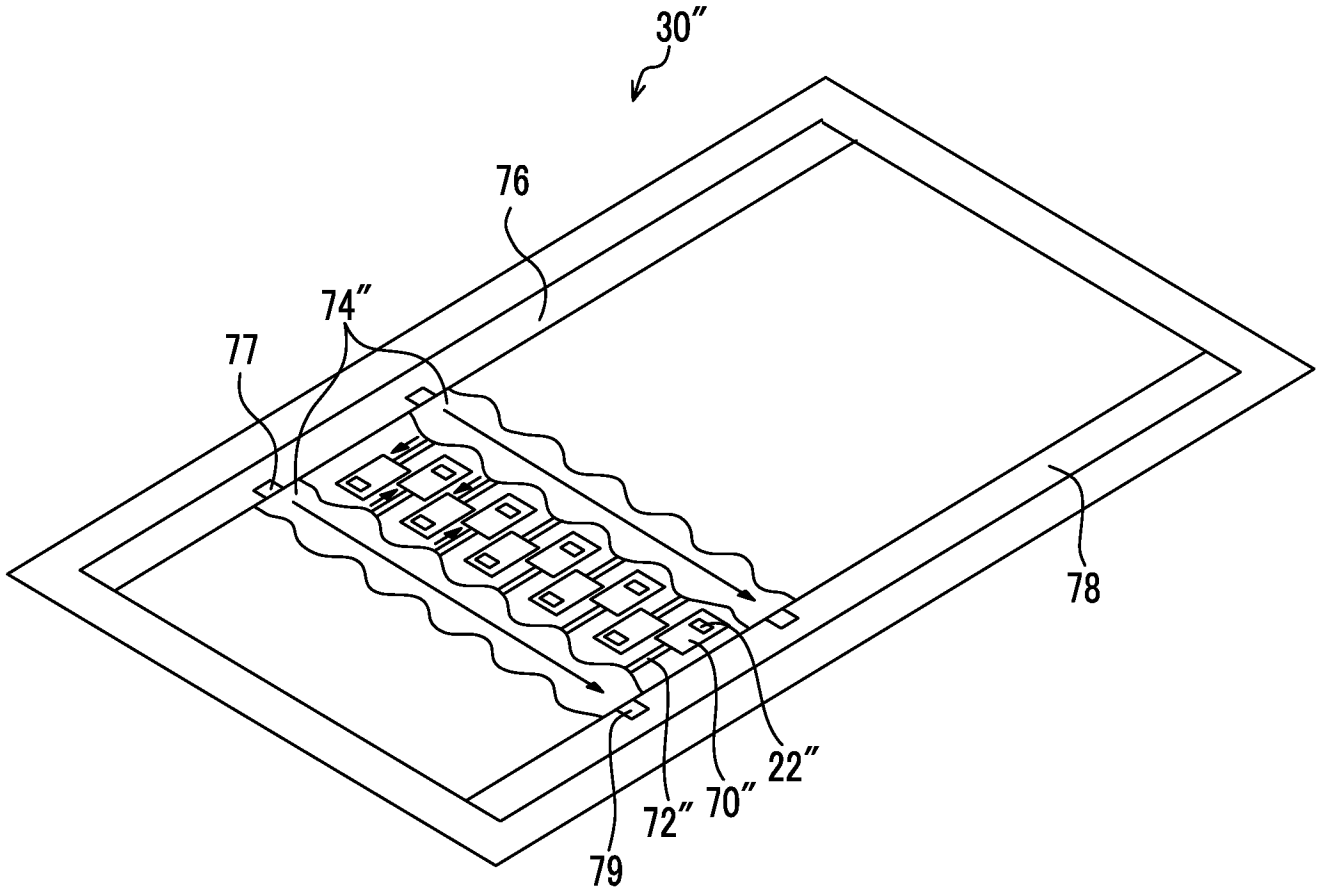
FIG. 9 is a planar perspective view illustrating the flow of liquid in another modified example of the discharge device substrate related to the first embodiment.

FIG. 9 is a planar perspective view of a discharge device substrate 30" illustrating another modified example of the ink jet head module related to the first embodiment. In an ink jet head module illustrated in FIG. 9, a nozzle 22" is formed via an individual supply flow path 72" in a direction from a common supply flow path 74" on one side of two common supply flow paths 74" to the common supply flow path 74" on the other side, and also with respect to the common supply flow path 74" on the other side, the nozzle 22" is formed via the individual supply flow path 72" in a direction from the common supply flow path 74" on the other side to the common supply flow path 74" on one side. With such a configuration, the nozzles 22' can be two-dimensionally disposed at a high density.

Second Embodiment

Figure 10:
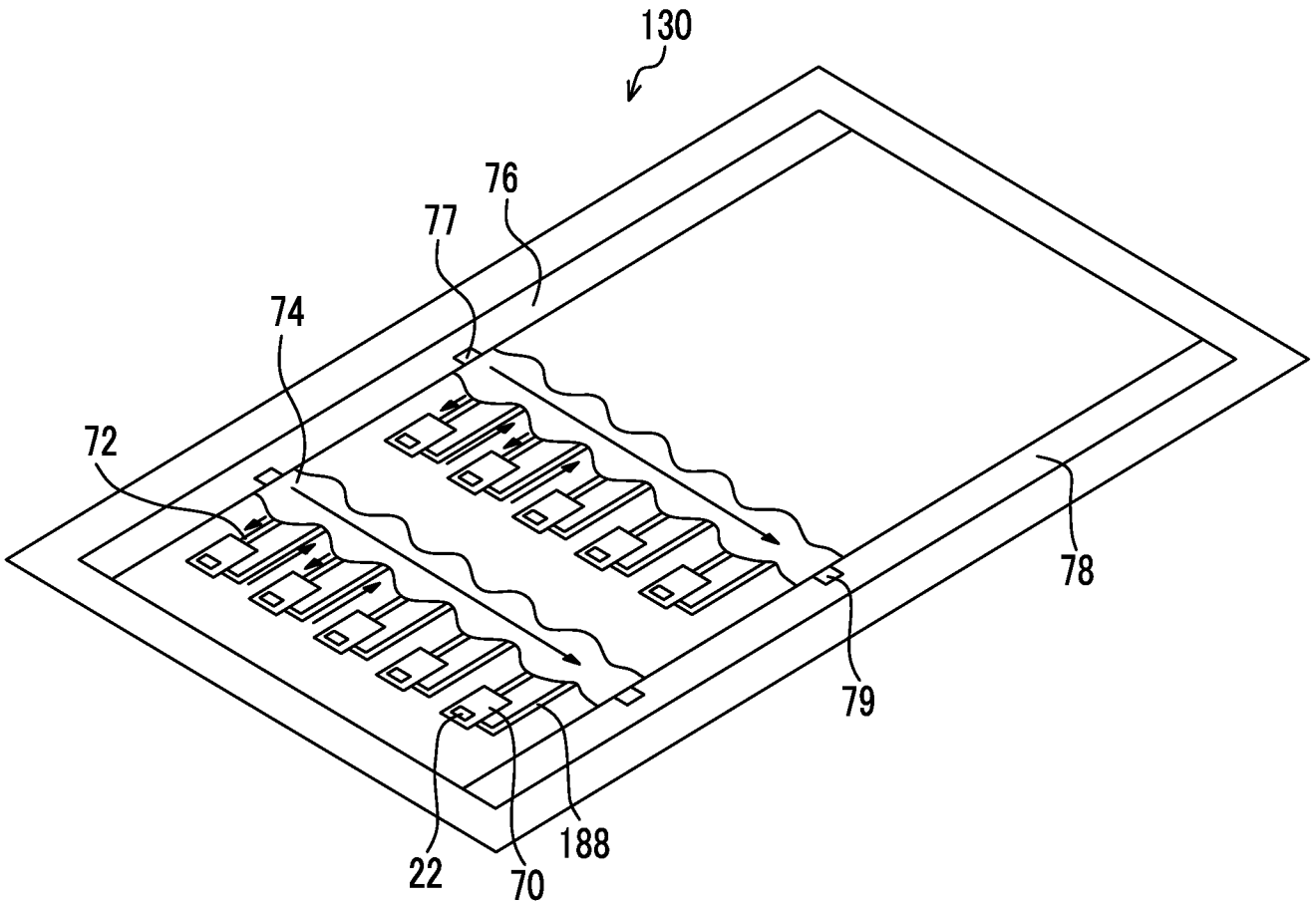
FIG. 10 is a planar perspective view illustrating the flow of liquid in a discharge device substrate related to a second embodiment.

FIG. 10 is a planar perspective view of a discharge device substrate 130 of an ink jet head module related to a second embodiment. The ink jet head module related to the second embodiment is different from that of the first embodiment in that a circulation flow path 188 connecting the communication path to the common supply flow path 74 is provided.

Retention of a meniscus which is formed in the nozzle 22 can be easily performed by providing the circulation flow path 188. Further, in this embodiment, the common supply flow path 74 is formed such that the cross-sectional area of a flow path structure is different, and connected to the circulation flow path 188 at a position where the cross-sectional area of the common supply flow path 74 is small, that is, a position corresponding to an area where the cross-sectional area is reduced. As described above, at the portion with a small cross-sectional area of the common supply flow path 74, pressure becomes small due to the Venturi effect. Therefore, by connecting the circulation flow path to a position where the cross-sectional area of the common supply flow path is small and connecting the individual supply flow path 72 to a position where the cross-sectional area is large, as described above, a difference in pressure is generated, and thus supply of liquid from the common supply flow path 74 to the nozzle and discharge of liquid from the circulation flow path 188 to the common supply flow path 74 can be easily performed, whereby circulation of liquid can be easily performed. Further, it is preferable that the circulation flow path 188 be connected to the common supply flow path 74 at a position further on downstream side than a position where the individual supply flow path 72 is connected to the common supply flow path 74. In this way, circulation of liquid can be easily performed without going against the flow of liquid in the entire flow path. Further, by performing the circulation of liquid (ink), thickening of liquid in the pressure chamber can be prevented and discharge or the like of foreign matters and air bubbles can be performed. In addition, it is acceptable if a position where the cross-sectional area of the common supply flow path 74 is small, to which the circulation flow path 188 is connected, is the position of the cross-sectional area smaller than the cross-sectional area of the common supply flow path 74 to which the individual supply flow path 72 corresponding to the circulation flow path 188 is connected.

Third Embodiment

Figure 11:
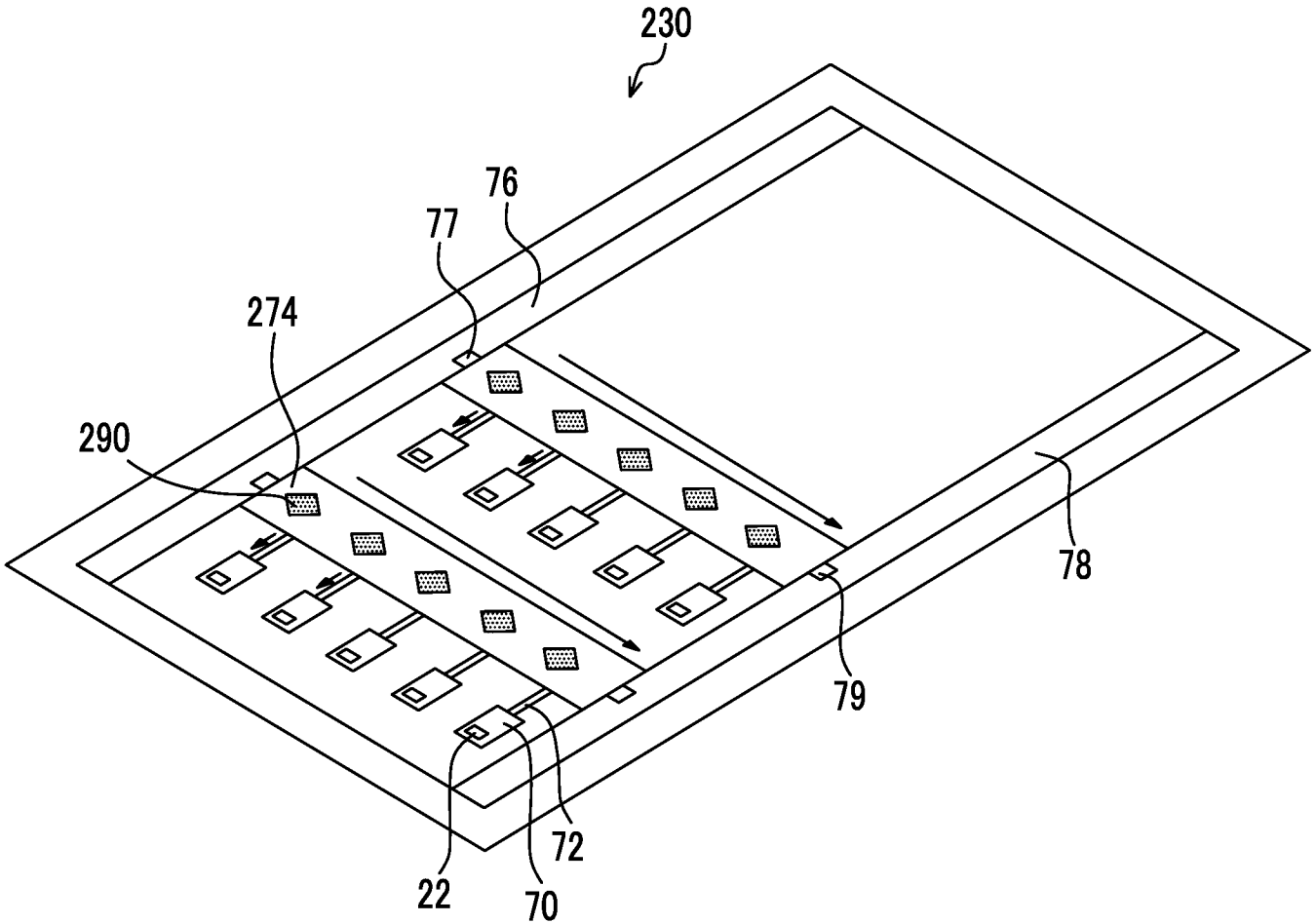
FIG. 11 is a planar perspective view illustrating the flow of liquid in a discharge device substrate related to a third embodiment.

FIG. 11 is a planar perspective view of a discharge device substrate 230 of an ink jet head module related to a third embodiment. The ink jet head module related to the third embodiment is different from that of the first embodiment in that a change in the cross-sectional area of a common supply flow path 274 is performed by providing an island-shaped member 290 in the common supply flow path 274.

As illustrated in FIG. 11, since the cross-sectional area of the common supply flow path 274 at the position of the common supply flow path 274 where the island-shaped member 290 is not formed can be made large, pressure can be increased and refill efficiency can be increased. Further, since the cross-sectional area of the common supply flow path 274 is changed by providing the island-shaped member 290, it is not necessary to form the wall surface of the common supply flow path 274 into a curved surface, as in the first embodiment and the second embodiment, and the wall surface can be formed in a straight line, and thus patterning can be easily performed.

Further, since liquid flow which flows via the common supply flow path 274 to avoid the island-shaped member 290 is generated by providing the individual supply flow path 72 immediately after a position where the island-shaped member 290 is provided, liquid can easily flow into the individual supply flow path 72 due to this flow. Therefore, due to use of the flow of liquid in addition to the effect due to an increase in cross-sectional area, refill efficiency can be improved.

In addition, a space via which liquid passes can also be provided between the island-shaped member 290 and the upper surface of the common supply flow path 274. In this manner, by providing a space on the top of the island-shaped member 290 and passing liquid therethvia, air bubbles mixed into the common supply flow path 274 pass via the space on the top of the island-shaped member 290, whereby air bubbles can be prevented from being mixed into the pressure chamber 70.

Modified Example

Figure 12:
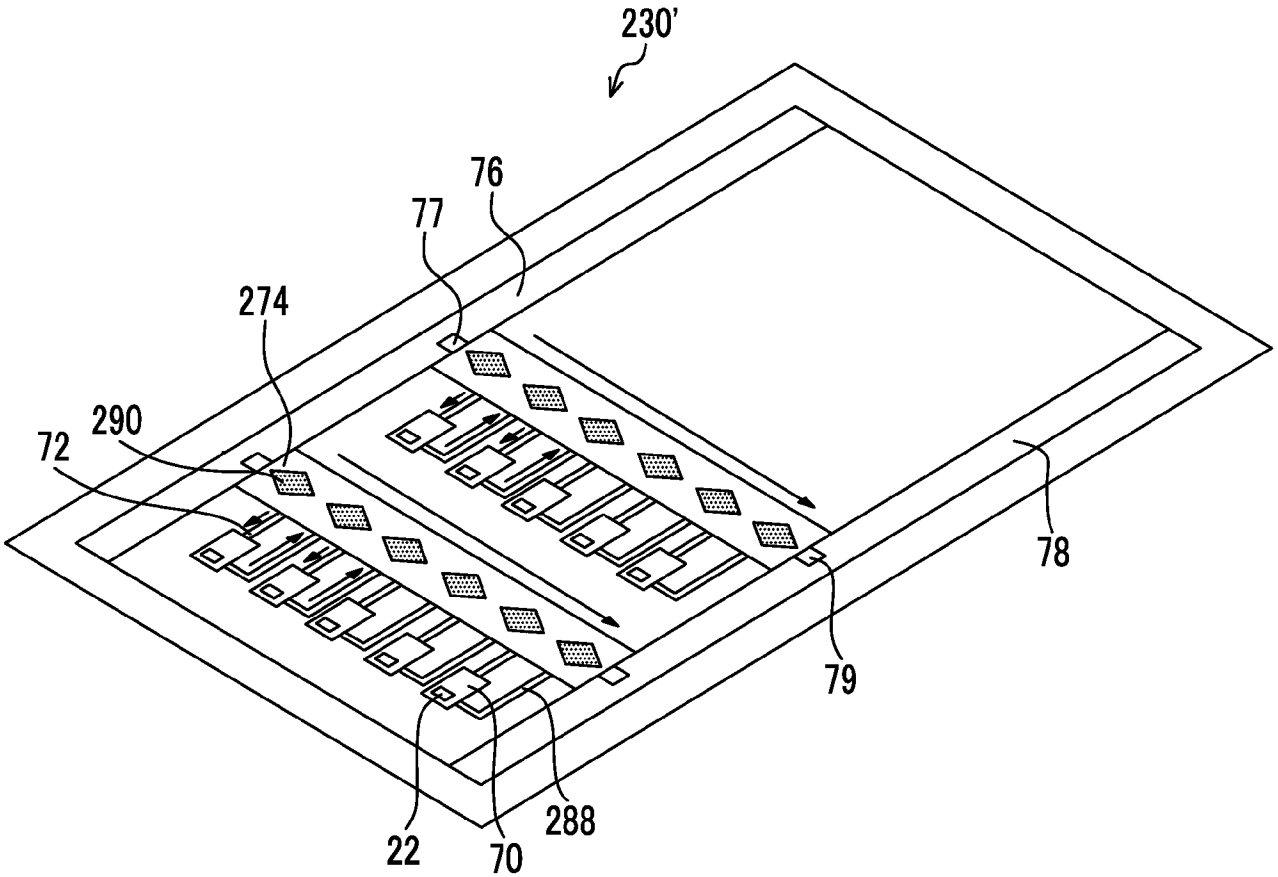
FIG. 12 is a planar perspective view illustrating the flow of liquid in a modified example of the discharge device substrate related to the third embodiment.

FIG. 12 is a planar perspective view of a discharge device substrate 230' illustrating a modified example of the ink jet head module related to the third embodiment. The ink jet head module illustrated in FIG. 12 is provided with a circulation flow path 288 which connects the communication path to the common supply flow path 274. Then, by connecting the circulation flow path 288 to a position where the cross-sectional area of the common supply flow path 274 is small, similarly to the second embodiment, circulation in the vicinity of the nozzle can be performed, and thus prevention of thickening of ink in the pressure chamber and discharge of foreign matters and air bubbles can be effectively performed. Further, it is preferable that the circulation flow path 288 be connected to the common supply flow path 274 at a position further on downstream side than a position where the individual supply flow path 72 is connected to the common supply flow path 274. In this way, circulation of liquid can be easily performed without going against the flow of liquid in the entire flow path.

Fourth Embodiment

Figure 13:
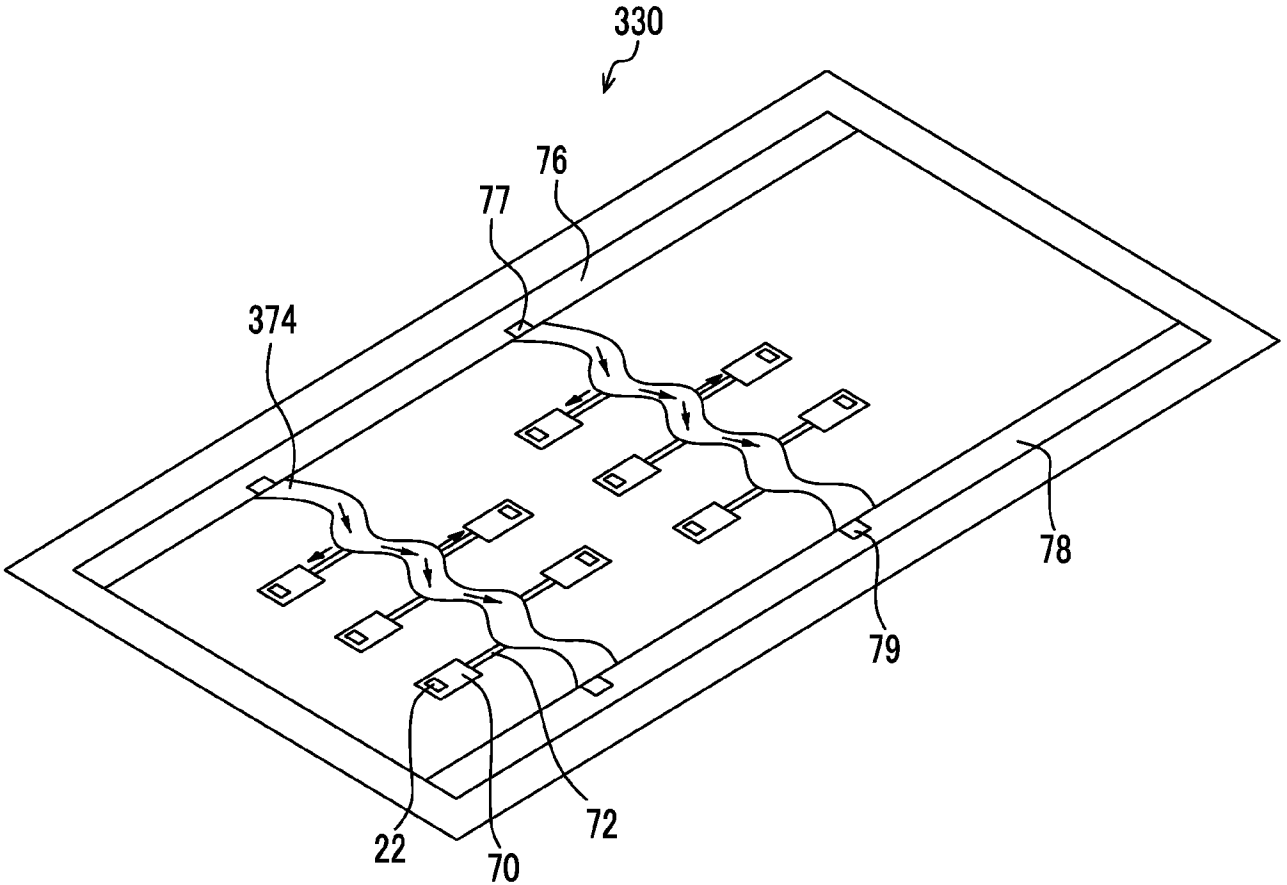
FIG. 13 is a planar perspective view illustrating the flow of liquid in a discharge device substrate related to a fourth embodiment.

FIG. 13 is a planar perspective view of a discharge device substrate 330 of an ink jet head module related to a fourth embodiment. In the ink jet head module related to the fourth embodiment, a common supply flow path 374 is formed in a wavy shape, whereby liquid flowing in the common supply flow path 374 flows in the same direction. Further, the common supply flow path 374 is formed such that the flow path width thereof is decreased.

As illustrated in FIG. 13, also in the common supply flow path 374 formed in a wavy shape, by providing the individual supply flow path 72 at a position where the cross-sectional area of the common supply flow path 374 is large, pressure is increased due to an increase in cross-sectional area, and thus refill efficiency can be improved. Further, since the common supply flow path 374 is formed in a wavy shape, whereby flow on the outer circumference in the common supply flow path 374 can be increased, refill efficiency can be further improved.

Modified Example

Figure 14:
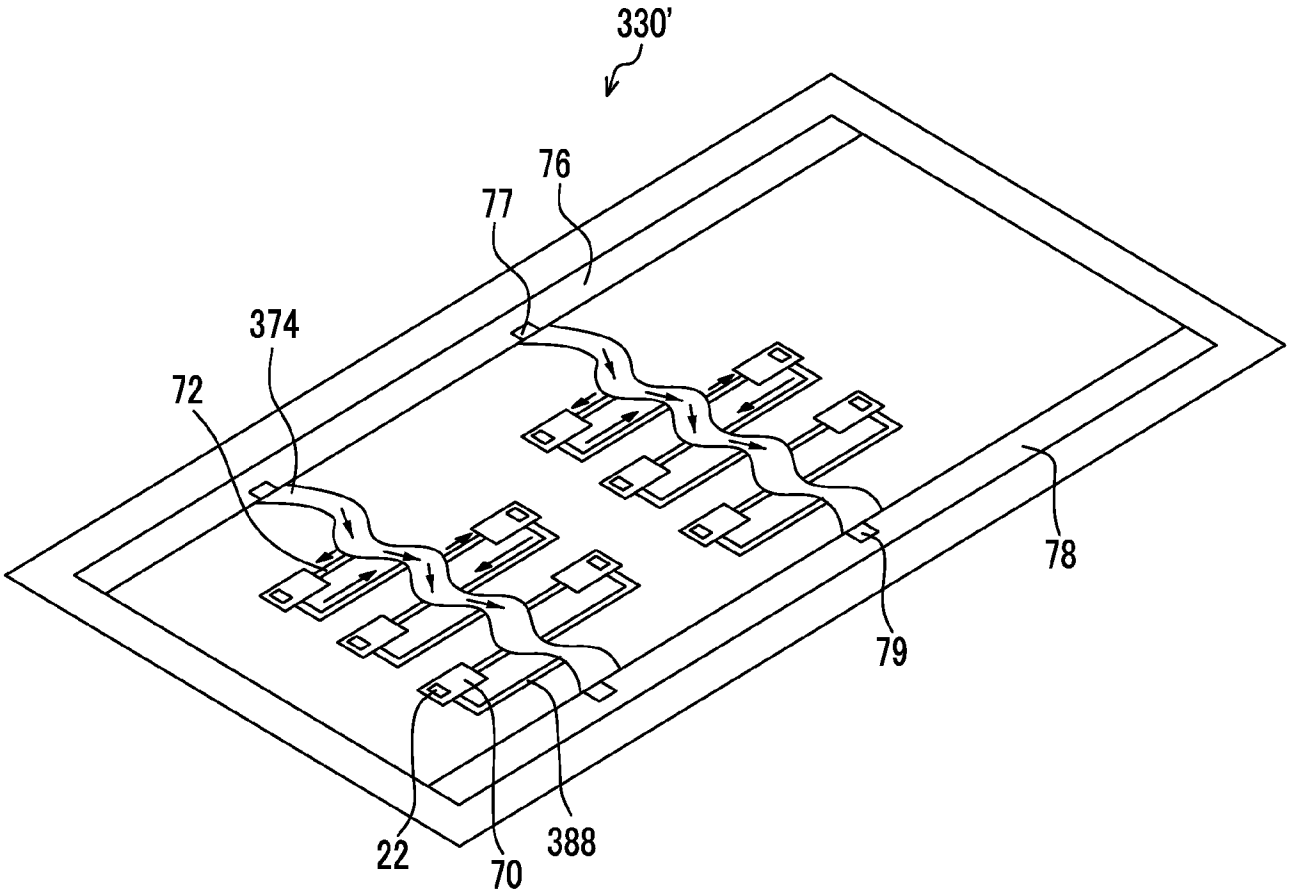
FIG. 14 is a planar perspective view illustrating the flow of liquid in a modified example of the discharge device substrate related to the fourth embodiment.

FIG. 14 is a planar perspective view of a discharge device substrate 330' illustrating a modified example of the ink jet head module related to the fourth embodiment. The ink jet head module illustrated in FIG. 14 is provided with a circulation flow path 388 which connects the communication path to the common supply flow path 374. Then, by connecting the circulation flow path 388 to a position where the cross-sectional area of the common supply flow path 374 is small, similarly to the second embodiment, circulation in the vicinity of the nozzle can be performed, and thus prevention of thickening of ink in the pressure chamber and discharge of foreign matters and air bubbles can be effectively performed. Further, it is preferable that the circulation flow path 388 be connected to the common supply flow path 374 at a position further on downstream side than a position where the individual supply flow path 72 is connected to the common supply flow path 374. In this way, circulation of liquid can be easily performed without going against the flow of liquid in the entire flow path.

Fifth Embodiment

Figure 15:
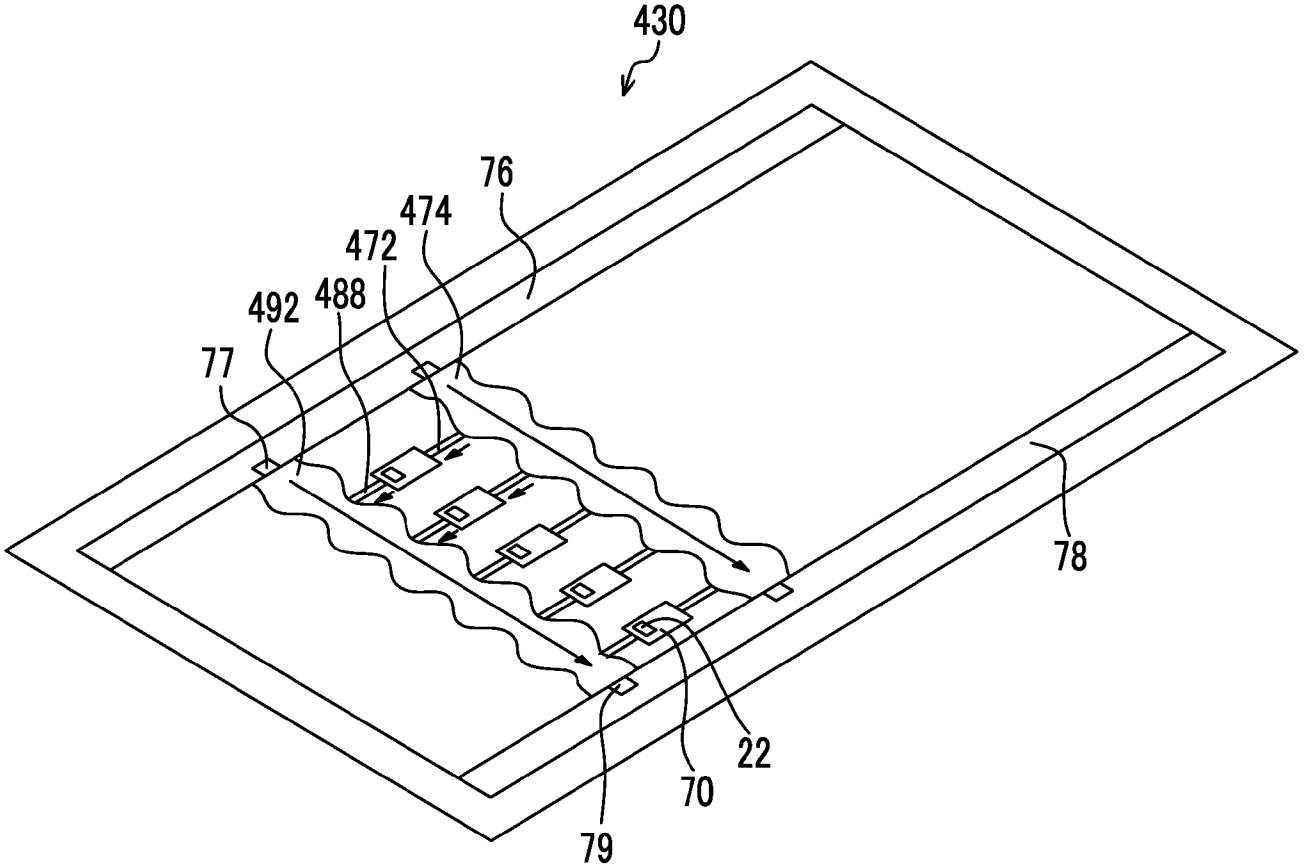
FIG. 15 is a planar perspective view illustrating the flow of liquid in a discharge device substrate related to a fifth embodiment.

FIG. 15 is a planar perspective view of a discharge device substrate 430 of an ink jet head module related to a fifth embodiment. The ink jet head module related to the fifth embodiment is different from those of other embodiments in that a common supply flow path 474 and a common recovery flow path 492 are provided.

As illustrated in FIG. 15, the common supply flow path 474 and the common recovery flow path 492 are provided, and thus liquid supplied from the common supply flow path 474 to the pressure chamber 70 is circulated by being recovered from a communication path 480 via a circulation flow path 488 to the common recovery flow path 492.

Since the common supply flow path 474 and the common recovery flow path 492 are provided, whereby air bubbles and foreign matters discharged from the pressure chamber 70 on the upstream side are circulated via the common recovery flow path 492, as in the above embodiments, air bubbles and foreign matters discharged from the pressure chamber 70 on the upstream side can be prevented from being mixed again into the pressure chamber 70 on downstream side.

Also in the fifth embodiment, the cross-sectional areas of the common supply flow path 474 and the common recovery flow path 492 are changed in the respective flow paths, an individual supply flow path 472 is provided at a position where the cross-sectional area of the common supply flow path 474 is large, and the circulation flow path 488 is provided at a position where the cross-sectional area of the common recovery flow path 492 is small. With such a configuration, supply of liquid to the individual supply flow path 472 and discharge of liquid from the circulation flow path 488 can be easily performed and refill efficiency can be improved.

As illustrated in the fifth embodiment, in a case where the common supply flow path 474 and the common recovery flow path 492 are provided separately, it is possible to change pressure by making the cross-sectional areas of the common supply flow path 474 and the common recovery flow path 492 different from each other, whereby refill efficiency can be improved. In this case, since the common supply flow path 474 and the common recovery flow path 492 can be formed in a linear fashion, manufacturing can be easily performed.

Figure 16:
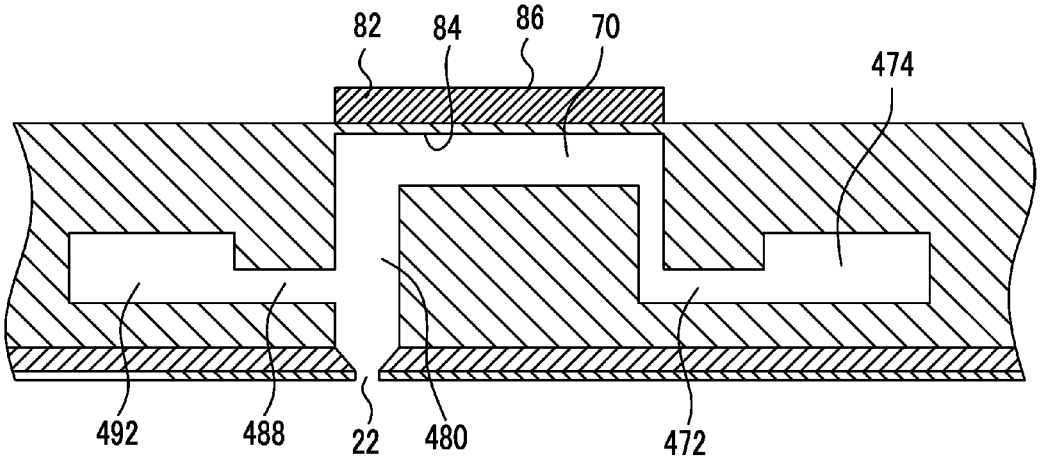
FIG. 16 is a cross-sectional view illustrating the flow of liquid in the discharge device substrate illustrated in FIG. 15.

FIG. 16 is a cross-sectional view of a flow path structure illustrated in FIG. 15. A configuration ranging from the common supply flow path 474 to the nozzle 22 is the same as that in the first embodiment. In the fifth embodiment, as illustrated in FIG. 16, the communication path 480 and the circulation flow path 488 are connected to each other and the circulation flow path 488 and the common recovery flow path 492 are connected to each other. Liquid in the pressure chamber 70 is circulated via the communication path 480, the circulation flow path 488, and the common recovery flow path 492.

Modified Example

Figure 17:
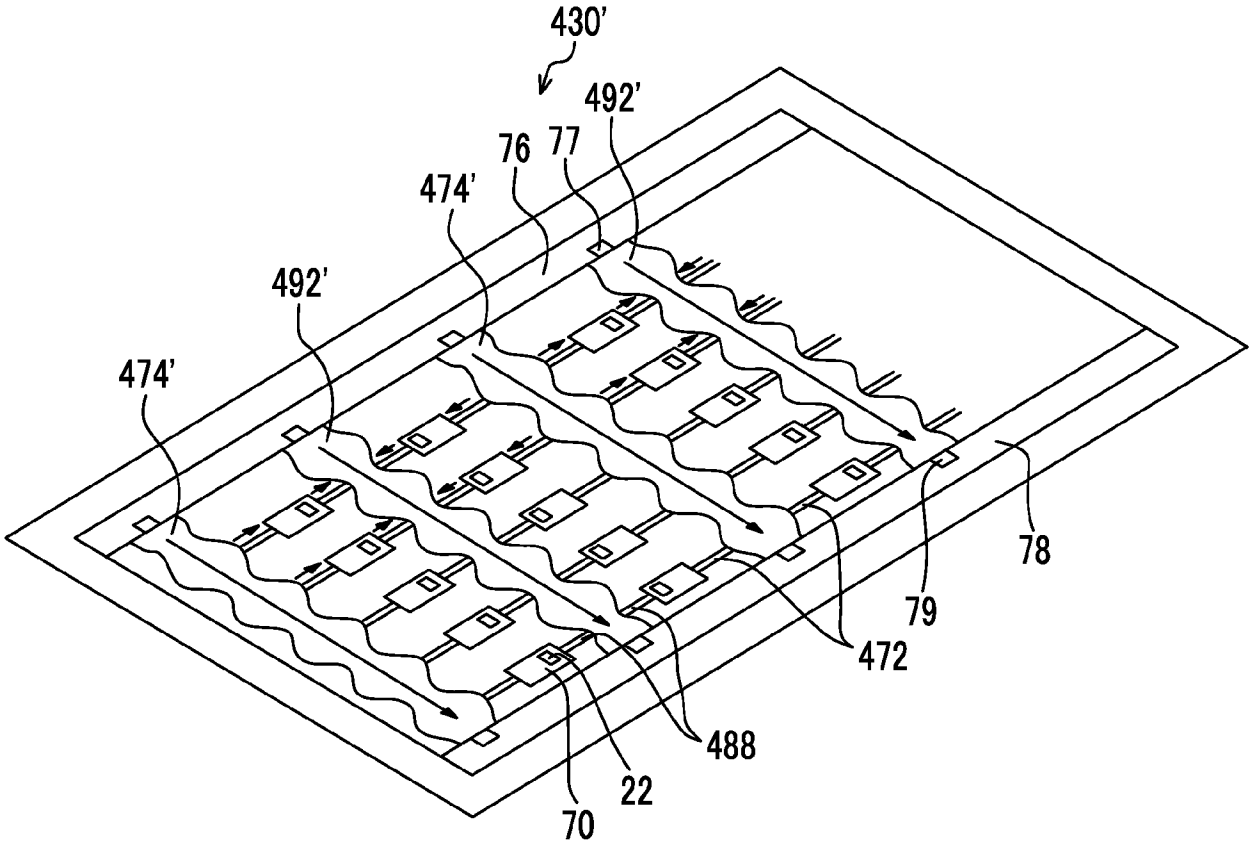
FIG. 17 is a planar perspective view illustrating the flow of liquid in a modified example of the discharge device substrate related to the fifth embodiment.

FIG. 17 is a planar perspective view of a discharge device substrate 430' illustrating a modified example of the ink jet head module related to the fifth embodiment. In the ink jet head module illustrated in FIG. 17, the pressure chambers 70 are connected to both sides of a single common supply flow path 474' via the individual supply flow paths 472. Further, liquid is recovered from both sides of a common recovery flow path 492' via the communication paths and the circulation flow paths 488 from the pressure chambers 70.

With such a configuration, since the common supply flow path 474' and the common recovery flow path 492' can be reduced in number, it is possible to dispose the nozzles at a high density. Further, in this case, the individual supply flow path 472 is connected to the common supply flow path 474' and the circulation flow path 488 is connected to the common recovery flow path 492'. In this way, air bubbles and foreign matters can be prevented from being mixed again into the pressure chamber 70.

In addition, each of the ink jet heads described above uses the head module in which nozzle disposition is formed in a matrix form. However, the invention is not limited thereto and the same flow path structure can also be made in a head module according to another aspect, such as a head module in which nozzles are arranged in a linear fashion. Further, the ink jet head according to the invention is mounted on a main body of an ink jet recording apparatus arbitrarily selected, thereby being able to constitute an ink jet recording apparatus.

What is claimed is:

1. An ink jet head comprising:

a plurality of nozzles forming a predetermined array;

a plurality of liquid chambers respectively provided for the nozzles;

a plurality of pressure generation elements respectively provided for the liquid chambers, which pressure generation elements respectively discharge liquid in the liquid chambers as a droplet from the nozzles;

a plurality of individual supply flow paths which respectively supply the liquid to the liquid chambers;

a common supply flow path that is connected to each individual supply flow path and supplies the liquid into each individual supply flow path; and a liquid supply unit that circulates the liquid of the common supply flow path so as to make the liquid flow in one direction in the common supply flow path, wherein the common supply flow path has a shape in which a cross-sectional area is increased and decreased at a predetermined interval and at a constant size by narrowing or widening a flow path width of the common supply flow path along an extending direction of the common supply flow path, and wherein each individual supply flow path is provided at a position where the cross-sectional area of the common supply flow path is at a largest.

2. The ink jet head according to claim 1, wherein the individual supply flow paths are provided on both sides of the common supply flow path.

3. The ink jet head according to claim 2, wherein the individual supply flow paths are provided on opposite sides facing each other of adjacent common supply flow paths.

4. The ink jet head according to claim 2, wherein the cross-sectional area of the common supply flow path is increased and decreased at the predetermined interval by narrowing or widening a flow path width of the common supply flow path.

5. The ink jet head according to claim 2, wherein the cross-sectional area of the common supply flow path is increased and decreased at the predetermined interval by providing an island-shaped member in the common supply flow path.

6. The ink jet head according to claim 2, wherein both side surfaces of the common supply flow path are formed so as to make the liquid in the common supply flow path flow in the same direction, and the common supply flow path has areas where the flow path width narrows and areas where the flow path width widens, whereby the cross-sectional area is increased and decreased at the predetermined interval.

7. The ink jet head according to claim 1, wherein the individual supply flow paths are provided on opposite sides facing each other of adjacent common supply flow paths.

8. The ink jet head according to claim 7, wherein the cross-sectional area of the common supply flow path is increased and decreased at the predetermined interval by narrowing or widening a flow path width of the common supply flow path.

9. The ink jet head according to claim 7, wherein the cross-sectional area of the common supply flow path is increased and decreased at the predetermined interval by providing an island-shaped member in the common supply flow path.

10. The ink jet head according to claim 7, wherein both side surfaces of the common supply flow path are formed so as to make the liquid in the common supply flow path flow in the same direction, and the common supply flow path has areas where the flow path width narrows and areas where the flow path width widens, whereby the cross-sectional area is increased and decreased at the predetermined interval.

11. The ink jet head according to claim 1, wherein the cross-sectional area of the common supply flow path is increased and decreased at the predetermined interval by providing an island-shaped member in the common supply flow path.

12. The ink jet head according to claim 11, wherein a space is provided between the island-shaped member and an upper surface of the common supply flow path.

13. The ink jet head according to claim 1, wherein both side surfaces of the common supply flow path are formed so as to make the liquid in the common supply flow path flow in a same direction, and the common supply flow path has areas where the flow path width narrows and areas where the flow path width widens, whereby the cross-sectional area is increased and decreased at the predetermined interval.

14. The ink jet head according to claim 1, further comprising:

a plurality of circulation flow paths which respectively circulate the liquid in the liquid chambers to the common supply flow path, wherein each circulation flow path is connected to a position where the cross-sectional area of the common supply flow path is decreased.

15. The ink jet head according to claim 14, wherein the circulation flow path is connected to the common supply flow path further on the downstream side than a position where a corresponding individual supply flow path is connected to the common supply flow path.

16. The ink jet head according to claim 1, further comprising:

a common recovery flow path having a shape in which a cross-sectional area is increased and decreased at a predetermined interval; and a plurality of circulation flow paths which respectively circulate the liquid in the liquid chambers to the common recovery flow path, wherein each circulation flow path is provided at a position where the cross-sectional area of the common recovery flow path is decreased.

17. An ink jet recording apparatus comprising: the ink jet head according to claim 1.

* * * * *